US005234190A

United States Patent [19]

Cross

[11] Patent Number: 5,234,190

[45] Date of Patent: Aug. 10, 1993

[54] LOCKING EASEL DISPLAY MOUNT

[76] Inventor: Carroll N. Cross, 3202 Holiday Ave., Apopka, Fla. 32703

[21] Appl. No.: 783,260

[22] Filed: Oct. 28, 1991

[51] Int. Cl.[5] ..... A47B 97/00

[52] U.S. Cl. ..... 248/459; 40/124.1; 248/465

[58] Field of Search ..... 248/459, 460, 465; 40/124.1, 120, 539, 152.1

[56] References Cited

U.S. PATENT DOCUMENTS

| | | | |
|---|---|---|---|
| 812,993 | 2/1906 | Harper | 248/459 |
| 1,962,089 | 6/1934 | Davidson | 248/459 |
| 2,472,405 | 6/1949 | Cross | 248/459 |
| 2,611,572 | 9/1952 | Rocca | 40/124.1 X |
| 2,803,076 | 8/1951 | Viglietta | 248/459 X |
| 3,275,281 | 9/1966 | Sampson | 248/459 X |
| 3,337,176 | 8/1967 | Tabor | 248/459 X |

*Primary Examiner*—David L. Talbott
*Attorney, Agent, or Firm*—William M. Hobby, III

[57] ABSTRACT

A locking easel stand display mount apparatus has a display panel and a backing panel having attached to the display panel. An easel stand is cut into the backing panel so that the easel stand can have angular movement away from the backing panel on a hinge. An easel locking tongue is formed in the easel stand for movement with respect thereto when the easel stand is moved away from the backing panel and engages the first panel to lock the easel stand in place. A hinge stiffening portion is formed in the easel stand hinge and includes a pair of parallel cuts in the backing panel at predetermined positions transverse to the easel stand hinge bending line in the panel. The hinge stiffening portion has a pair of bending lines between the two cuts and spaced from the hinge bending line so that an easel stand will bend on a plurality of interrupted hinge lines and produce a hinge stiffening portion. When the easel stand portion is rotated, the hinge stiffening portion pops up to form a bridge-like stiffening portion.

3 Claims, 1 Drawing Sheet

LOCKING EASEL DISPLAY MOUNT

BACKGROUND OF THE INVENTION

The present invention relates to a display mount having a locking easel and especially to a display mount having a hinge stiffening portion formed in the easel stand hinge.

In the past, a great variety of displays for displaying calendars and the like have been provided. Typically, these display mounts are made of cardboard which has a plurality of calendar leaves attached by staples, stitches, or placed in pockets on the display mount. The display may be provided with some means for supporting the display, such as having a rear hinged to the other to hold the panels in position. The display mounts of the type having easel members formed integrally with the back boards thereof have been hinged to the back boards along straight lines. In the use of such mounts, it has been difficult to prevent the easel member from spreading with respect to the board to such an extent that the mount was not held in a proper display position. Millions of display mounts have been sold which using locking easels and one way locking easels which depend upon the force or tension at the scored hinge to prevent the easel member from spreading but sequential rotation at the hinge eventually causes the easel to collapse. The present invention provides a solution to this problem by having a display mount having an scored easel hinge having a bridge formed in the middle thereof by two cut lines running transverse to the hinge line and then scored lines between the cut lines which forms a bridge when the easel is rotated on the hinge line and locked in place to thereby maintain a continuous force on the easel.

In my prior U.S. Pat. No. 2,472,405 dated Jun. 7, 1949, I provided a solution to this problem by having a base member and a support member secured to the base member for pivotal movement with respect thereto along a deflected line which is curved or angular. In my prior U.S. Pat. No. 2,240,209 dated Apr. 29, 1941, I provided a display mount with an easel mount which provided greater strength and resistance to warping while using lightweight flexible materials. In my U.S. Pat. No. 2,092,348 of Sep. 7, 1937, I disclosed a Display Mount construction using a plurality of lightweight members.

Other display mounts for calendar pads and the like may be seen in my prior U.S. Pat. No. 2,355,706 for a display mount having a well in the face thereof for displaying materials such as calendar pads, and in U.S. Pat. No. 3,058,410 and U.S. Pat. No. 3,079,715 for an improved display mount structure and improved method for forming the display windows and display wells in display mount structures. In addition, my prior patents on display and photomounts may be seen in U.S. Pat. No. 3,216,582; U.S. Pat. No. 3,068,139; and U.S. Pat. No. 3,002,720, which include my patent on an aluminum hinge which allows a supporting prop or other display mount supports to be mounted with a flexible hinged panel which stays in place without the use of interconnecting tongues, or the like. Other display mount patents of mine include a Display Mount Apparatus and Method, U.S. Pat. No. 4,523,399; a Display Mount, U.S. Pat. No. 4,199,883; a Display Mount and Method, U.S. Pat. No. 4,351,123; a Display Mount with Protected Thermometer, U.S. Pat. No. 4,263,733; a Display Mount and Method, U.S. Pat. No. 4,326,906; a Method of Making a Display Mount, U.S. Pat. No. 4,285,683; and a Method of Making a Hinged Display Mount, U.S. Pat. No. 4,299,643. In my prior Patent for Display Book Apparatus, U.S. Pat. No. 4,288,935, I combined a display and book combination which allowed a calendar to swing forward to give access for a phone or reference book. In prior U.S. Pat. No. 3,188,113 for a Paper Holder with V-shaped pen receptacle has a display mount with pencil or pen holders formed therein.

The present invention is for a display mount having a locking easel stand which provides a new hinge portion for the easel stand which creates a bridge like portion across the easel stand hinge line to increase the pressure on the easel stand.

SUMMARY OF THE INVENTION

The present invention relates to a display mount having a locking easel stand which has a display panel and a backing panel having a plurality of edges and attached to the display panel. An easel stand is cut into the backing panel and has three edges formed in the backing panel so that the easel stand can have angular movement away from the backing panel on a hinge. An easel locking tongue is formed in the easel stand for movement with respect thereto when the easel stand is moved away from the backing panel. The locking tongue is adapted to engage the first panel to lock the easel stand in a display panel support position. A hinge stiffening portion is formed in the easel stand hinge and includes a pair of parallel cuts in the backing panel at predetermined positions transverse to the easel stand hinge bending line in the panel. The hinge stiffening portion has a pair of additional bending lines between the two cuts and spaced from the hinge bending line so that an easel stand will bend on a plurality of interrupted hinge lines and produce a hinge stiffening portion. The hinge stiffening portion two cuts are generally parallel to each other and perpendicular to the easel stand hinge line and may be scored between the ends of the parallel cuts to form two additional hinge lines parallel to and spaced from the easel stand hinge line which is interrupted by the transverse cuts. When the easel stand portion is rotated, the hinge stiffening portion pops up to form a bridge-like stiffening portion against the easel locking tongue which has a tab on the end thereof connected to an opening in the display panel.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
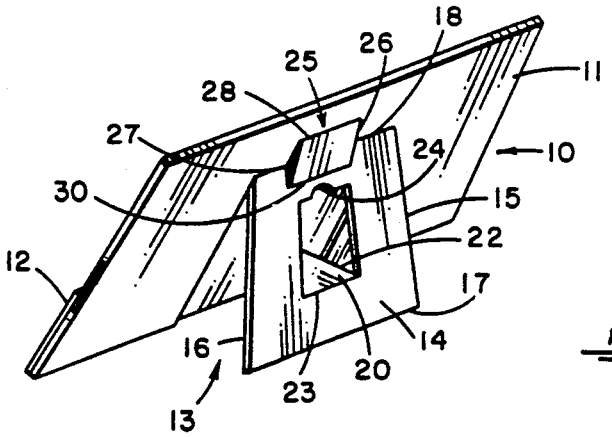
FIG. 1 is a rear perspective view of a display mount in accordance with the present invention with the easel stand in an open locked position.
Figure 2:
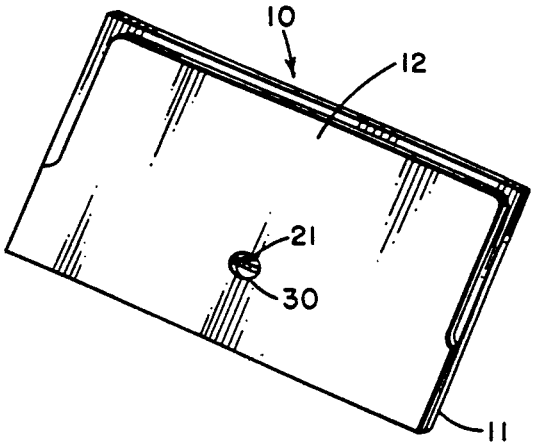
FIG. 2 is a front perspective view of the display mount of FIG. 1.

Referring to the drawings and especially to FIGS. 1 through 5, a display mount 10 is illustrated having a rear or backing panel 11 and a front or display panel 12 and having a locking easel stand 13. The locking easel stand 13 has a easel stand member 14 having two cut edges 15 and 16 and an end edge 17 with a scored hinged line 18 formed so that the easel stand 14 can be rotated on the hinge line 18 to open it away from the rear panel 11. A locking tongue 20 has a tab 21 on the end thereof and is cut in the back of the easel stand 14 with a plurality of cut edges 22 and bends on the hinge line 23. A tab 21 is die cut at 24 into the easel stand 14 and scored in the hinge line 18 for the easel.

Stand 14 has a hinge stiffening member 25 which is formed with two parallel die cut lines 26 and 27 running transverse to or across the hinge line 18. Hinge line 18 may be a scored line which is interrupted by the two cuts 26 and 27. The hinge stiffening member 25 may have a pair of hinge lines 28 and 30 which may be scored the same as the hinge line 18. The hinge line 18 could, of course, be perforated or otherwise marked than by scoring without departing from the spirit and scope of the invention. Looking at FIG. 3, the hinge portion of the easel stand 14 includes the main hinge line 18 intersected by a generally rectangular section 25 formed of two cuts 26 and 27 connected by a pair of hinge lines 28 and 30 which are parallel to each other and to the hinge line 18. The offset hinge lines 28 and 30 intersect the traverse and parallel cuts 26 and 27.

Figure 4:
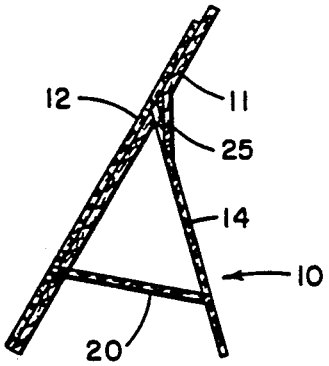
FIG. 4 is a side sectional view through the display mount of FIG. 1.
Figure 5:
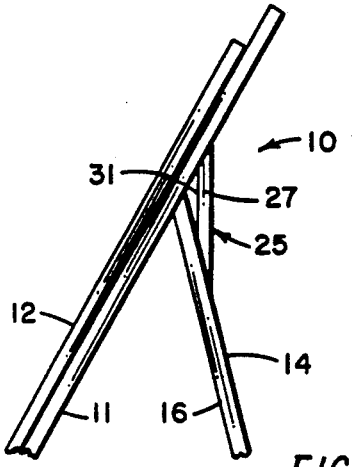
FIG. 5 is an end elevation of the open display mount in accordance with FIGS. 1 and 4.
Figure 3:
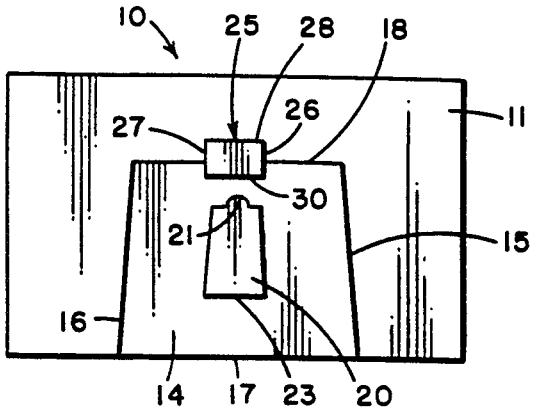
FIG. 3 is a rear elevation of the display mount of FIGS. 1 and 2 having the easel stand in a flat, closed position.

In operation, the display mount, as shown in FIG. 3, is shipped flat and the easel stand portion 14 can be lifted while pushing in the locking tongue 20 until the tab 21 engages an opening 30 in the display panel 12 which then holds the easel stand member 14 in a locked position, as shown in FIGS. 1, 4 and 5. Common practice has been to use the hinge line 18 to provide the stiffening for the easel stand member 14 but in practice this has resulted in the display calendars collapsing as the hinge weakens with use. In the present invention, when the easel stand member 14 is being opened, as shown in FIGS. 1, 4 and 5, by rotation on the hinge line 18, the two parallel shorter hinge lines 28 and 30 force the bridge portion 25 to lift along the cuts 26 and 27 to put a greater stiffening or tension on the easel stand member 14 when in its locked easel stand position, as shown in FIGS. 1, 4 and 5. This thereby leaves a gap 31 where the bridge portion 25 has been lifted away from the back panel 11 separate from the easel stand member 14 and tongue 20.

The hinge portion in accordance with the present invention has three parallel scored hinge lines with the one hinge line 18 broken into two hinge lines by cuts 26 and 27. This hinge has been shown to overcome a problem that has existed in the industry in connection with locking tongue easel stand display mounts for many years which problem was partially solved by my prior U.S. patent for a display mount with an angular easel hinge. However, the present invention is not to be construed as limited to the form shown which is to be considered illustrative rather than restrictive.

I claim:

1. A display mount having an easel stand comprising:

a display panel having a plurality of edges and an opening therein;

a backing panel having a plurality of edges and being attached to said display panel;

an easel stand cut into said backing panel and having three edges formed in said backing panel, said easel stand having an angular movement away from said backing panel on a hinged area and into a supporting position;

an easel locking tongue formed in said easel stand for movement with respect thereto when said easel stand is moved away from said backing panel, said locking tongue adapted to lock said easel stand in a display panel support position and an easel locking tongue having a tab on the end thereof for connection in said display panel opening; and a hinge stiffening portion formed into said easel stand hinged area and including a pair of cuts across a hinge pending line in said backing panel where said easel stand bends and a pair of bend lines connecting said cross cuts, whereby said easel support will bend on a plurality of interrupted hinge lines.

2. A display mount having an easel stand in accordance with claim 1 in which there are two cuts through said backing panel across said hinge line.

3. A display mount having an easel stand in accordance with claim 2 in which said two cross cuts are parallel cuts through said backing panel.

* * * * *